US008260195B2

(12) United States Patent
Neal et al.

(10) Patent No.: US 8,260,195 B2
(45) Date of Patent: Sep. 4, 2012

(54) METHOD TO MINIMIZE DATA DOWNLOAD DURING SATELLITE RADIO BROADCASTS

(75) Inventors: Mark O. Neal, Rochester, MI (US); Robert P. Roesser, Southfield, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 527 days.

(21) Appl. No.: 12/576,006

(22) Filed: Oct. 8, 2009

(65) Prior Publication Data

US 2011/0086591 A1 Apr. 14, 2011

(51) Int. Cl.
*H04H 40/00* (2008.01)

(52) U.S. Cl. ..... 455/3.06; 455/3.01; 455/3.02

(58) Field of Classification Search ..... 455/3.01–3.06, 455/12.1, 503
See application file for complete search history.

(56) References Cited

U.S. PATENT DOCUMENTS

| | | | |
|---|---|---|---|
| 6,785,656 | B2 | 8/2004 | Patsiokas et al. |
| 6,834,156 | B1 | 12/2004 | Marko et al. |
| 6,876,835 | B1 | 4/2005 | Marko et al. |
| 6,993,316 | B2 | 1/2006 | Marko et al. |
| 7,020,217 | B1 | 3/2006 | Parsons et al. |
| 7,180,917 | B1 | 2/2007 | Marko et al. |
| 7,231,270 | B2 | 6/2007 | Kamdar et al. |
| 7,310,496 | B2 | 12/2007 | Schill et al. |
| 2003/0203714 | A1 | 10/2003 | Videtich et al. |
| 2003/0204577 | A1 | 10/2003 | Videtich |
| 2005/0009466 | A1 | 1/2005 | Kamdar et al. |
| 2006/0040609 | A1 | 2/2006 | Petschke et al. |
| 2006/0094349 | A1 | 5/2006 | Slesak et al. |

FOREIGN PATENT DOCUMENTS

WO WO 2004/097803 A2 11/2004

*Primary Examiner* — Raymond Dean
(74) *Attorney, Agent, or Firm* — John A. Miller; Miller IP Group, PLC

(57) ABSTRACT

A system and method for limiting the amount of satellite radio digital bandwidth used by allowing a vehicle to record and store songs broadcast by the satellite and then play the songs from the vehicle the next times the songs are to be broadcast. When a song is selected to be broadcast, the method determines whether a certain percentage of vehicles will have the song recorded on the vehicle, and if so, will broadcast a song code identifying the song to allow the vehicle to play the recorded song.

20 Claims, 2 Drawing Sheets

METHOD TO MINIMIZE DATA DOWNLOAD DURING SATELLITE RADIO BROADCASTS

BACKGROUND OF THE INVENTION

1. Field of the Invention

This invention relates generally to a system and method for storing broadcast data on a vehicle that will be played from the vehicles memory during future broadcasts of the same data and, more particularly, to a system and method for storing satellite radio music broadcasts on a vehicle so that the vehicle can play a song intended to be broadcast from the satellite so as to conserve satellite bit-rate, sometimes referred to as digital bandwidth, and possibly use it for other purposes.

2. Discussion of the Related Art

Satellite radio is becoming increasingly more popular. Modern vehicles are typically equipped with satellite radios, and offer incentives for a subscription to the satellite broadcasts for some period of time. As is well understood in the art, satellite broadcasts allow the vehicle to continuously receive the broadcasts for a satellite channel as the vehicle moves over a large range, which typically is not possible for terrestrial radio. Satellite radio offers a number of formats, including many types of music broadcasts, talk radio, sports, traffic, weather, etc. Music broadcasts are typically determined by some programming schedule where certain songs may be played very regularly, intermittently, etc. The digital bandwidth used by satellite radio is very limited and thus it is desirable to conserve as much digital bandwidth as possible for these transmissions.

Modern vehicles also typically include a number of systems that need to be continually updated in order for them to be effective. For example, vehicles that include navigation systems where the vehicle operator will enter a destination and the navigation system will program a route from the vehicle's location to that destination require map databases that store the roads and their names that can be displayed to provide the navigation capability. Because road systems are constantly changing, the map databases need to be continuously updated to be effective, which can be provided by satellite transmissions. Other applications that need to be updated include road closure information, weather and traffic transmissions, entertainment systems, etc.

SUMMARY OF THE INVENTION

In accordance with the teachings of the present invention, a system and method are disclosed for limiting the amount of satellite radio digital bandwidth used for many musical channels by allowing a vehicle to record and store songs broadcast by the satellite and then play the songs from the vehicle at subsequent times the songs are to be played. The method includes providing a song playlist from which songs to be broadcast are selected. When a song is selected to be played, the method determines whether a certain percentage of vehicles will have that song recorded on the vehicle. If the method determines that the certain percentage of vehicles do have the song recorded, the satellite will broadcast a song code identifying that song, and the vehicle will play the song from its memory, instead of the satellite broadcasting the song so as to save digital bandwidth. If a particular vehicle falls outside the predetermined percentage of vehicles that include the recorded song, then the radio will play a substitute song in its place, where the vehicle recorded the other song at an earlier time. If the certain percentage of vehicles does not have the song recorded, then the satellite broadcasts the song to allow the vehicles that do not have it recorded to store the song for later playback when the scheduling of the playlist replays the song. If a particular vehicle does have the song stored, it can determine whether the broadcast of the song has a better song quality, and if so, replace the new stored version of the song with the old stored version of the song. Further, the method can include broadcasting a song schedule from the satellite to allow vehicles to wake up at a predetermined time to record songs that they do not already have recorded.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a system and method for playing a stored song on a vehicle in response to a satellite radio system intending to broadcast that song is merely exemplary in nature, and is in no way intended to limit the invention or its applications or uses. For example, the system and method of the invention has particular application for storing satellite broadcast transmissions on a vehicle. However, the present invention may be used for non-vehicle applications and non-satellite broadcast applications.

Figure 1:
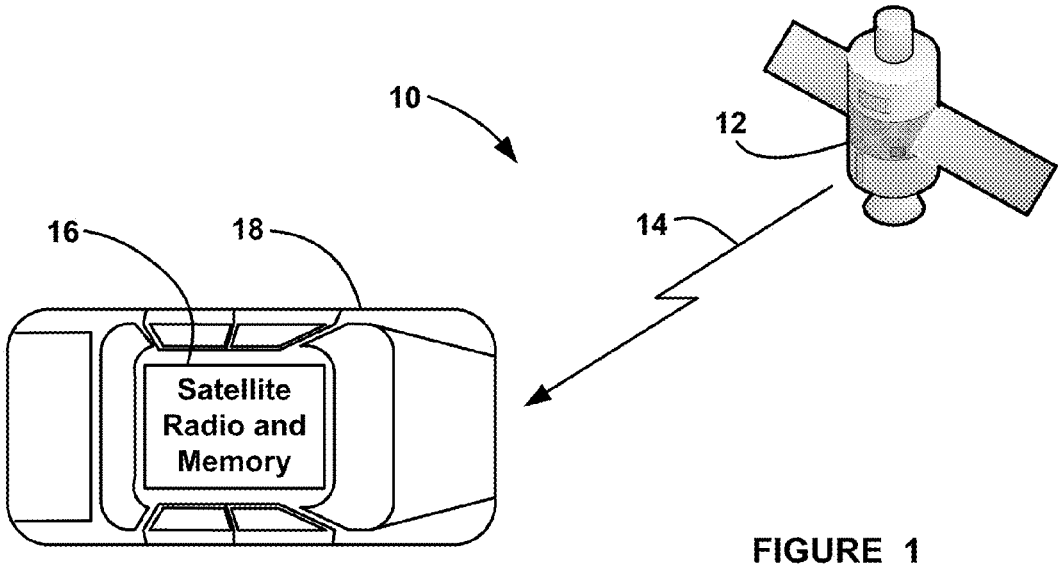
FIG. 1 is an illustration of a satellite broadcasting radio transmissions to a vehicle satellite radio.

FIG. 1 is an illustration of a satellite radio system 10 where a satellite 12 broadcasts transmissions 14 to a satellite radio 16 on a vehicle 18. Currently, satellite radio systems are XM radio and Sirius radio. However, the present invention is intended to cover any satellite broadcast transmissions suitable for the purposes described herein including high definition FM radio and other digital broadcast media. Further, the present invention is intended to cover other types of repetitive broadcasts other than satellite broadcasts.

As mentioned above, the digital bandwidth required to broadcast the many channels for satellite radio from the satellite 12 is typically very expensive. However, hard drive storage is becoming less and less expensive. The present invention provides a satellite radio system where music to be broadcast by the satellite that may be rebroadcast many times in the future is stored on the vehicle's hard drive, and when a particular song is played again, the satellite 12 will send a code identifying the song that causes the vehicle 18 to play the recorded song instead of using the digital bandwidth necessary to broadcast the song to be played by the satellite radio 16. In this manner, transmission digital bandwidth is saved because the actual song is not transmitted by the satellite 12, where the cost to store the song on the vehicle is not significant. Although the discussion herein talks about broadcasting music and songs that may be rebroadcast, the storage of such information on the vehicle 18 is intended to be any suitable broadcast that may be replayed, such as comedy shows, radio drama shows, replayed talk shows, etc. Therefore, the vehicle operator will retain that disk jockey type selection of songs to be listened to without actually knowing that the vehicle is playing the stored song that the disk jockey has selected.

The process referred to above of storing music or other information in the vehicle to be played in place of the broadcast song has a number of details that need to be addressed in order to be effective. As will be discussed in further detail below, the present invention proposes addressing situations where a vehicle may not have the song recorded that is intended to be broadcast, how the system determines whether it broadcasts a song or a song code indicating that the song should be played from the vehicle memory and how vehicles can record the songs when they are broadcast by the satellite.

Figure 2:
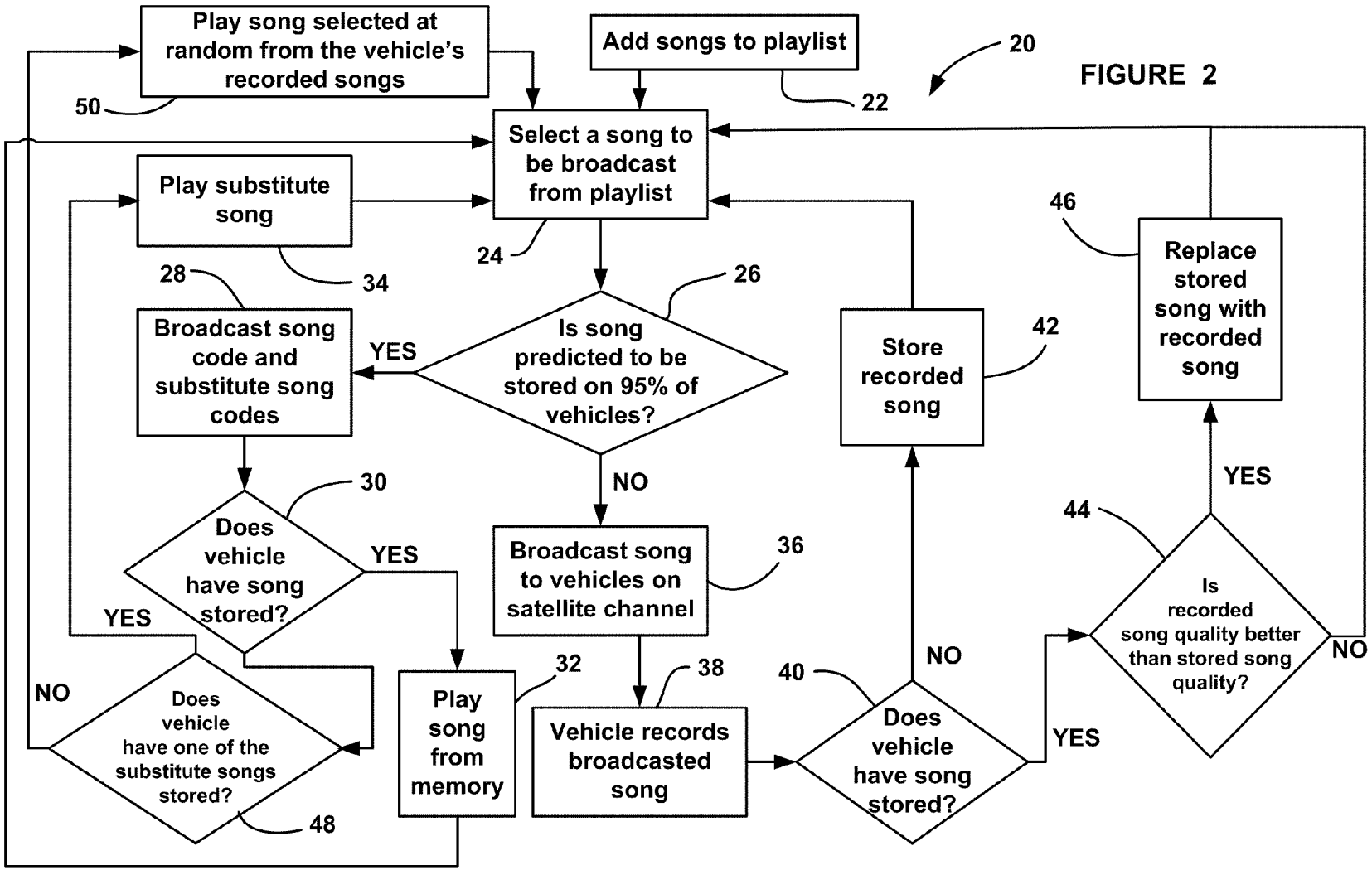
FIG. 2 is a flow chart diagram showing a process for playing songs to be broadcast from a satellite on the vehicle itself and storing songs in the vehicle that the satellite may be broadcasting.

FIG. 2 is a flow chart diagram 20 showing a process for a satellite radio that includes playing a stored song on a vehicle in response to receiving a signal that that song is to be played from the satellite 12 and recording and storing a song in the vehicle 18 if the vehicle 18 does not already have the song. Songs are continually and systematically added to a song playlist for the satellite radio system at box 22 for future music scheduling and broadcasts for various types of music and various music channels in the system. A disk jockey, or some other radio personnel, will select a song to be broadcast from the playlist at box 24. The system algorithm used to determine whether the actual song will be broadcast or a song code identifying the song will be broadcast is determined at decision diamond 26, where the algorithm determines whether a predicted number of vehicles will include the recorded song. In this non-limiting example, 95% of the vehicles need to have the song stored in order for the song code to be sent instead of the song. The algorithm can make the predicted determination of what percentage of the vehicles have the song stored in any suitable manner, such as by the number of vehicles that had the song prerecorded on their hard drive when the vehicle was manufactured, how many times the song has previously been played, what times the song has been broadcast, etc.

If the algorithm determines that at least the predetermined percentage of vehicles has the song stored at the decision diamond 26, then it broadcasts a song code identifying the song at box 28, instead of the actual song itself. Therefore, those vehicles that have the song stored will play the song from their hard drive instead of receiving the song from the satellite 12 to be played. For those vehicles that do not have the song stored, the satellite 12 will also broadcast a number of substitute song codes so that, hopefully, every vehicle that does not have the primary song stored will have at least one of the substitute songs stored that can be played during that time frame. Thus, a particular vehicle determines whether it has the song stored at decision diamond 30, and if so, plays the song from its memory at box 32. If the particular vehicle does not have the song stored at the decision diamond 30, then the algorithm will determine if the vehicle has one of the substitute songs stored at decision diamond 48. If the vehicle does not have any of the substitute songs stored, then the algorithm will cause the vehicle to play a song selected at random from the vehicle's recorded songs of the same genre at box 50, and then return to selecting a song at the box 24. If the vehicle does have one or more of the substitute songs stored at the decision diamond 48, it will play one of the substitute songs at box 34 from the list of substitute song codes sent by the satellite 12 based on a predetermined priority schedule. The process then returns to selecting a next song from the playlist at the box 24.

If the algorithm determines that the predetermined percentage of vehicles do not have the song stored at the decision diamond 26, then the satellite 12 will broadcast the song on the particular satellite channel at box 36. Each vehicle that receives the broadcasted song will then record the song at box 38. The algorithm will then determine whether a particular vehicle has the song stored at decision diamond 40 from a previous recording of a broadcast of the song. If the vehicle does not have the song stored at the decision diamond 40, then the algorithm will store the recorded song at box 42 and return to the box 24 for the next song to be broadcast. If the vehicle does have the song stored at the decision diamond 40, the algorithm determines whether the new recorded version of the song has a better quality than the stored version of the song at decision diamond 44, and if so, replaces the stored song version with the newly recorded song version at box 46, and returns to the next selection of songs at the box 24. If the newly recorded version of the song is not of a better quality than the stored song at the decision diamond 44, then the algorithm discards the newly recorded version of the song and returns to the box 24 to wait for the next selected song.

Figure 3:
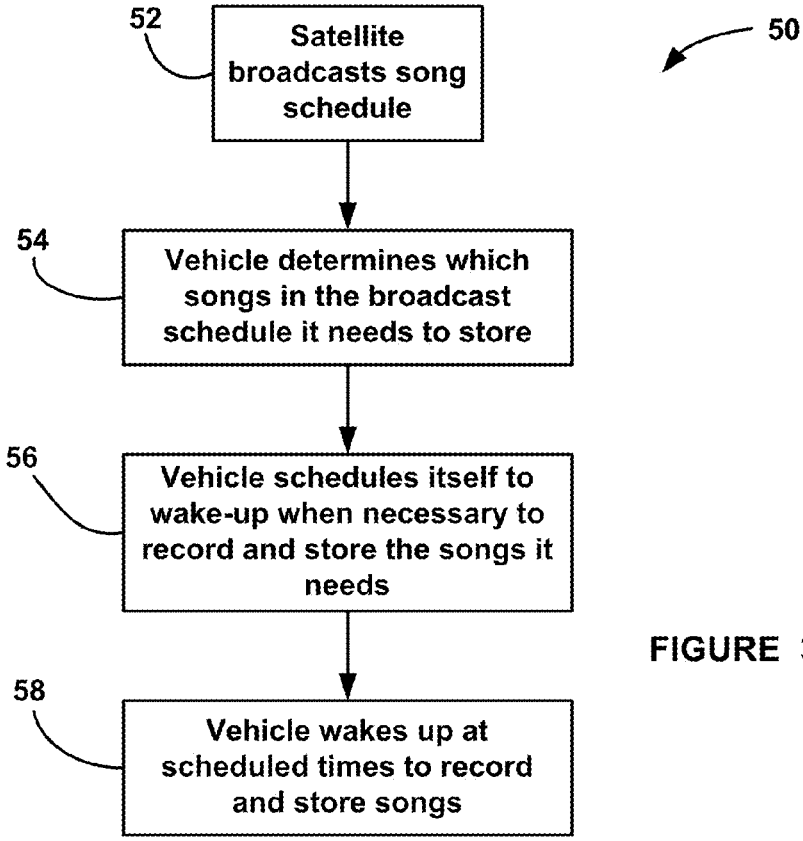
FIG. 3 is a flow chart diagram showing a process for causing a vehicle to wake up during a satellite broadcast of a song so that the vehicle can record and store the song.

For those vehicles that may not have their XM radio on very often or may not have many opportunities to store broadcasted songs for some reason, the present invention also provides a technique to allow those, or other, vehicles to store broadcast songs. Particularly, FIG. 3 is a flow chart diagram 50 showing a process for allowing vehicles to record and store songs based on a predetermined broadcast schedule. At box 52, the satellite 12 broadcasts a song transmission schedule to all of the vehicles. Each vehicle determines which song in the broadcast schedule it does not have stored and needs to record and what time those songs will be broadcast at box 54. Based on this determination, the vehicle schedules itself to "wake-up" when necessary to record the songs that it does not have stored based on the satellite broadcast schedule at box 56. The vehicle then wakes up at that time to record and store those songs at box 58. The broadcast schedule of the songs may be performed at night when limited broadcasts are being transmitted so that that digital bandwidth is available to be used to transmit the songs for recording.

By reducing the digital bandwidth required to transmit songs from the satellite 12, less digital bandwidth is required to be paid for, for the particular service, or the saved digital bandwidth can be used for other purposes. For example, as discussed above, map databases need to be constantly updated in order for them to be effective. The digital bandwidth can be used for this purpose without requiring a dedicated satellite channel. Other types of transmissions that may be desirable for the vehicle 18 include enhanced real-time traffic information, gas price information, parking availability, news alerts, travel advisories, sports, etc.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A method for operating a broadcast system, said method comprising:

selecting a file to be broadcast;

determining whether the selected file is stored on a predetermined percentage of vehicles that may receive the broadcast of the selected file;

broadcasting a primary file code identifying the selected file if it is determined that the predetermined percentage of vehicles do have the selected file stored;

using the primary file code to retrieve the selected file from a vehicle memory if a vehicle has the selected file stored;

playing the selected file from the vehicle memory; and broadcasting the selected file if it is determined that the predetermined percentage of vehicles do not have the selected file stored.

2. The method according to claim 1 further comprising broadcasting one or more substitute file codes when the primary file code is broadcast and playing a substitute file that is stored on a vehicle that does not have the selected file stored.

3. The method according to claim 1 further comprising recording the selected file on each vehicle that receives the selected file if it is determined that the predetermined percentage of vehicles do not have the selected file stored.

4. The method according to claim 3 further comprising determining whether the recorded file has already been stored on the vehicle, and if so, determining whether the recorded file is of a higher quality than the stored file, and if so, replacing the stored file with the recorded file.

5. The method according to claim 1 wherein the predetermined percentage is 95%.

6. The method according to claim 1 further comprising broadcasting a file schedule identifying when certain files will be broadcast and determining in each vehicle which files in the broadcast schedule are not stored on the vehicle.

7. The method according to claim 6 further comprising waking the vehicle up to record and store a file based on the broadcast file schedule if the vehicle determines that it needs to record and store a particular file in the file schedule.

8. The method according to claim 1 wherein the broadcast system is a satellite radio system that broadcasts the files.

9. The method according to claim 1 wherein the file is a song.

10. A method for operating a satellite radio system, said method comprising:

selecting a song to be broadcast from the satellite;

determining whether the selected song is stored on a predetermined percentage of vehicles that may receive the broadcast of the selected song;

broadcasting a primary song code identifying the selected song if it is determined that the predetermined percentage of vehicles do have the selected song stored;

using the song code to retrieve the selected song from a vehicle memory if a vehicle has the selected song stored;

playing the selected song from the vehicle memory;

broadcasting the selected song from the satellite if it is determined that the predetermined percentage of vehicles do not have the selected song stored;

broadcasting one or more substitute song codes when the satellite broadcasts the primary song code and playing a substitute song that is stored on a vehicle that does not have the selected song stored;

recording the broadcasted song on each vehicle that receives the broadcasted song if it is determined that the predetermined percentage of vehicles do not have the primary song stored; and determining whether the recorded song has already been stored on the vehicle, and if so, determining whether the recorded song is of a higher quality than the stored song, and if so, replacing the stored song with the recorded song.

11. The method according to claim 10 wherein the predetermined percentage is 95%.

12. The method according to claim 10 further comprising broadcasting a song schedule from the satellite identifying when certain songs will be broadcast from the satellite and determining in each vehicle which songs in the broadcast schedule are not stored on the vehicle.

13. The method according to claim 12 further comprising waking the vehicle up to record and store a song based on the broadcast song schedule if the vehicle determines that it needs to record and store a particular song in the song schedule.

14. A system for operating a satellite radio, said system comprising:

means for selecting a file to be broadcast from the satellite;

means for determining whether the selected file is stored on a predetermined percentage of vehicles that may receive the broadcast of the selected file;

means for broadcasting a primary file code identifying the selected file if it is determined that the predetermined percentage of vehicles do not have the selected file stored;

means for using the file code to retrieve the selected file from a vehicle memory if a vehicle has the selected file stored;

means for playing the selected file from the vehicle memory; and means for broadcasting the selected file from the satellite if it is determined that the predetermined percentage of vehicles do not have the selected file stored.

15. The system according to claim 14 further comprising means for broadcasting one or more substitute file codes when the satellite broadcasts the primary file code and playing a substitute file that is stored on a vehicle that does not have the selected file stored.

16. The system according to claim 14 further comprising means for recording the selected file on each vehicle that receives the selected file if it is determined that the predetermined percentage of vehicles do not have the selected file stored.

17. The system according to claim 16 further comprising means for determining whether the recorded file has already been stored on the vehicle, and if so, determining whether the recorded file is of a higher quality than the stored file, and if so, replacing the stored file with the recorded file.

18. The system according to claim 14 wherein the predetermined percentage is 95%.

19. The system according to claim 13 further comprising means for broadcasting a file schedule from the satellite identifying when certain files will be broadcast from the satellite and determining in each vehicle which files in the broadcast schedule are stored on the vehicle.

20. The system according to claim 19 further comprising means for waking the vehicle up to record and store a file based on the broadcast file schedule if the vehicle determines that it needs to record and store a particular file in the file schedule.

* * * * *